US007201780B2

(12) United States Patent
Schoots

(10) Patent No.: US 7,201,780 B2
(45) Date of Patent: Apr. 10, 2007

(54) METHOD FOR DYEING TEXTILES

(75) Inventor: Harrie Peter Schoots, Haverhill, MA (US)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 11/454,052

(22) Filed: Jun. 14, 2006

(65) Prior Publication Data

US 2006/0282957 A1 Dec. 21, 2006

Related U.S. Application Data

(60) Provisional application No. 60/691,147, filed on Jun. 16, 2005.

(51) Int. Cl.
*D06P 1/30* (2006.01)
*D06P 1/00* (2006.01)

(52) U.S. Cl. ..... 8/630; 8/588; 8/653

(58) Field of Classification Search ..... 8/653, 8/618, 588, 630
See application file for complete search history.

(56) References Cited

U.S. PATENT DOCUMENTS

| | | | | |
|---|---|---|---|---|
| 3,000,688 | A * | 9/1961 | Schubert et al. | 8/587 |
| 3,118,724 | A | 1/1964 | Goerrig et al. | |
| 3,124,411 | A * | 3/1964 | Panson et al. | 8/606 |
| 3,127,231 | A * | 3/1964 | Neale | 8/630 |
| 3,195,974 | A * | 7/1965 | Neale | 8/630 |

* cited by examiner

*Primary Examiner*—Lorna M. Douyon
*Assistant Examiner*—Amina Khan
(74) *Attorney, Agent, or Firm*—Kenneth Crimaldi

(57) ABSTRACT

A method for dyeing textiles with reducible dyes in the presence of borohydride and bisulfite.

4 Claims, No Drawings

METHOD FOR DYEING TEXTILES

This is a non-provisional application of prior pending U.S. provisional Application Ser. No. 60/691,147 filed on Jun. 16, 2005.

This invention relates generally to a method for dyeing textiles with reducible dyes, using a borohydride compound and a bisulfite compound.

A method for dyeing textiles with reducible dyes is disclosed in U.S. Pat. No. 3,124,411, which describes reduction of the dyes with sodium bisulfite and sodium borohydride. However, this reference teaches reduction of dyes in a dyebath having a high pH, typically 11.3, and at a relatively high temperature of 80° C. These harsh conditions are undesirable for safety reasons and for their adverse effect on the textiles. Commercially, textiles typically are dyed under similar conditions, using hydrosulfite to reduce the dyes.

The problem addressed by this invention is to find a safer and more efficient process using bisulfite and borohydride for dyeing textiles with reducible dyes.

STATEMENT OF THE INVENTION

This invention is directed to a method for dyeing textiles with reducible dyes. The method comprises steps of: (a) combining ingredients comprising water, a bisulfite compound, a borohydride compound and a reducible dye to form a dyebath; and (b) contacting the dyebath with a textile comprising cotton; wherein the dyebath has a pH from 9 to 11 when formed.

DETAILED DESCRIPTION OF THE INVENTION

All percentages are expressed as weight percentages, unless specified otherwise. The term "reducible dyes" refers to textile dyes that are treated with chemical reducing agents as part of the dyeing process, e.g., vat dyes, sulfur dyes and indigoid dyes.

Dithionite ion, also referred to as hydrosulfite, can be produced by the reaction between bisulfite and borohydride ions, according to the following theoretical equation:

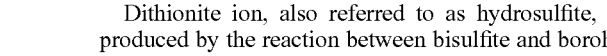

$$BH_4^- + 8HSO_3^- + H^+ \rightarrow 4S_2O_4^{-2} + B(OH)_3 + 5H_2O$$

The yield is somewhat less than 100% due to competing reactions, including that of borohydride with water, but is most often better than 85%. Since the exact mechanism of the reaction has not been fully characterized, this invention is not limited to reduction by dithionite ion, and other species present in the reaction mixture also may act as reducing agents. When the amount of bisulfite is at 8 moles per mole of borohydride, the theoretical reaction proceeds to completion. Without wishing to be bound by theory, it is believed that use of more than the theoretical amount of bisulfite or less than the theoretical amount of bisulfite results in a mixture containing hydrosulfite, sodium bisulfite, borohydride and possibly other species. Preferably, the bisulfite compound is sodium bisulfite (SBS). Preferably, the borohydride compound is sodium borohydride.

The pH of the dyebath when formed, before it is placed in contact with the textile, is from 9 to 11. Preferably, the pH is no more than 10.8, more preferably no more than 10.6, and most preferably no more than 10.5. Preferably, the pH is at least 9.5, more preferably at least 9.8, and most preferably at least 10. These initial pH values for the dyebath may change while the dyebath is in contact with the textile.

In a preferred embodiment of the invention, borohydride is added in the form of an aqueous solution containing sodium borohydride (SBH) and sodium hydroxide ("liquid sodium borohydride"). A preferred liquid sodium borohydride for use in accordance with the methods of the invention is in liquid form and comprises about 1% to about 36% active sodium borohydride and about 20 to about 45% NaOH or $Na_2CO_3$ (also known as soda ash), all by weight. Preferably, liquid sodium borohydride comprises 10% to 15% sodium borohydride and 35% to 40% NaOH. A particularly preferred borohydride composition comprises about 12% active sodium borohydride and about 40% NaOH. For example, 100 g of this solution contains 12 g sodium borohydride, 40 g NaOH, and 48 g $H_2O$. Bisulfite preferably is added as an aqueous solution. Some of the bisulfite is consumed in a neutralization reaction with the hydroxide ion present in the liquid sodium borohydride. In one embodiment of the invention, combining water and sodium metabisulfite, $Na_2S_2O_5$, generates bisulfite. The aqueous sodium bisulfite preferably is about 2% to about 45% active by weight.

The amount of bisulfite compound added to form the dyebath (in grams per liter of dyebath) preferably is from 1.5 g/L to 4 g/L, more preferably from 2 g/L to 3.5 g/L, and most preferably from 2.4 g/L to 3.1 g/L. The amount of borohydride compound added to form the dyebath preferably is from 0.05 g/L to 0.14 g/L, more preferably from 0.06 g/L to 0.13 g/L, and most preferably from 0.07 g/L to 0.11 g/L.

The weight ratio of bisulfite compound to reducible dye added to form the dyebath preferably is from 1.2:1 to 3.2:1, more preferably from 1.6:1 to 2.8:1, and most preferably from 1.9:1 to 2.5:1. The weight ratio of borohydride compound to reducible dye added to form the dyebath preferably is from 0.04:1 to 0.11:1, more preferably from 0.05:1 to 0.1:1, and most preferably from 0.06:1 to 0.09:1.

The textile to be dyed by the method of this invention comprises cotton. It may be cotton or a cotton blend. Preferably, a cotton blend is at least 50% cotton, more preferably at least 70%. The textile may be in the form of yarn, fabric or fibers, and may be died in continuous or batch operations.

In one embodiment of the invention, most of the borohydride and bisulfite, and the reducible dye are combined in an initial aqueous mixture with additional hydroxide and allowed to stand for a holding period of at least 1 hour, preferably from 1 to 3 hours. This holding period allows reduction and solubilization of the reducible dye. During the holding period the aqueous mixture may be allowed to stand without agitation, or alternatively, it may be agitated. This initial aqueous mixture is also referred to as the "master batch." Preferably, the temperature of the master batch during the holding period is at least ambient temperature, and preferably no more than 70° C., more preferably no more than 60° C., and most preferably no more than 50° C. Preferably the temperature is at least 30° C. The pH of the master batch is higher than that of the mixture with which the textile is contacted. Preferably, the amount of borohydride added to form the master batch is from 2 to 6 g per liter of master batch, more preferably from 3 to 5 g per liter, and most preferably from 3.5 to 4.5 g per liter. Preferably, the amount of bisulfite added to form the master batch is from 65 to 180 g per liter of master batch, more preferably from 80 to 160 g per liter, and most preferably from 100 to 140 g per liter. Preferably, a hydroxide compound is added to the master batch in an amount from 40 to 110 g per liter of master batch, more preferably from 60 to 90 g per liter. The preceding amounts of added hydroxide compound are exclusive of hydroxide compound introduced as part of liquid borohydride. Preferably, a liquid borohydride contains 35–40% sodium hydroxide, and the total amount of added hydroxide compound can easily be calculated. Preferably, the pH of the master batch is from 11 to 14, more preferably from 12 to 14, and most preferably from 13 to 13.5. Preferably the hydroxide compound is an alkali metal hydroxide, most preferably sodium hydroxide. Preferably, the amount of reducible dye added to form the master batch is from 70 to 105 g per liter of master batch, more preferably from 75 to 95 g per liter, and most preferably from 80 to 90 g per liter.

In this embodiment, after the holding period, all or a part of the master batch is combined with additional bisulfite and borohydride, and optionally, additional hydroxide, and diluted with water to produce the dyebath which is to be contacted with the textile. The additional chemicals bring the total amounts of borohydride and bisulfite added to the amounts described above for the dyebath, and the pH within the range described above. Of course, the amounts of borohydride, bisulfite and hydroxide actually present in the dyebath will be lower than the amounts added because at least a portion of these chemicals will have undergone chemical reactions, including those described above, to form other species.

The dyebath may have other components typically used in textile dyeing, including, e.g., surfactants and finishing agents, e.g., softeners. Preferred surfactants include non-ionic surfactants. Preferably, a surfactant is added in an amount from 0.03 to 0.09 g per liter of dyebath, more preferably from 0.05 to 0.07.

Preferably, the textile to be dyed is contacted with the dyebath at a temperature from 25° C. to 70° C., preferably from 30° C. to 45° C. Typical contact time with the dyebath is from 10 seconds to 30 seconds. Preferably, excess dyebath is removed from the textile, e.g., with rollers, and the textile is allowed to air-oxidize for at least 15 seconds, preferably at least 60 seconds; and preferably no longer than 90 seconds. Typically, the textile is contacted with the dyebath more than once, preferably at least three times; and preferably no more than 8 times.

EXAMPLES

Example 1

Dyeing Cotton With Indigo Dye Using SBH/SBS

The master batch was prepared as an aqueous mixture by combining the following amounts, in grams per liter of master batch (g/L):

| Ingredient, % Active | Amount, g/L | g/L Active Added |
|---|---|---|
| sodium bisulfite, 39% | 315.4 | 123.0 |
| liquid SBH, 12% (40% NaOH) | 34.25 | 4.11 |
| NaOH, 50% | 153.8 | 76.9 |
| Indigo Dye (Vat Blue 1) | 86 | 86 |

The pH of the master batch was 13.34 and the oxidative reduction potential (ORP) was −800 mV, as measured by a pH meter. The master batch was allowed to stand for two hours at ambient temperature with no agitation and then a portion was combined with additional SBH and SBS, and diluted with water to produce the dyebath, as follows, with amounts expressed per liter of dyebath:

| Ingredient | Amount | g/L Active Added |
|---|---|---|
| Master Batch | 14.67 mL/L | SBH: 0.0603<br>SBS: 1.804<br>Dye: 1.262 |
| SBS, 39% | 2.4 g/L | SBS: 0.936 |
| SBH, 12% | 0.26 g/L | SBH: 0.0312 |

The total amount of SBH in g/L added to form the dyebath (amount added to the master batch+additional amount added to the dyebath) was 0.0603+0.0312=0.0915 g/L. The total amount of SBS added to form the dyebath was 1.804+0.936=2.74 g/L. The pH of the dyebath when formed was 10.08 and the ORP was −659 mV.

The dyebath was contacted with a 100% cotton rope at ambient temperature by running the rope through the dyebath for 17 seconds, squeezing it at 1 to 1.3 bar ($1\times10^5$ to $1.3\times10^5$ Pa) and then allowing it to air-oxidize for 60 seconds. This process was repeated 5 additional times, and followed by 3 cold water rinses of 17 seconds each, and drying.

Other dyebaths were prepared and used according to this procedure, but with varying amounts of NaOH to produce pH values of 10.08, 10.5, 10.6, 10.7 and 10.8. Color test results from these dyebaths were as presented in the following table. Delta values are relative to an indigo-dyed fabric (using hydrosulfite under similar conditions—see Comparative Example 1) having color characteristics on the L*a*b* color scale of L*:19.41, a*:0.03 and b*:−15.24.

$$\Delta E = \sqrt{(\Delta L^*)^2 + (\Delta a^*)^2 + (\Delta b^*)^2}$$

| pH | ΔL* | Δa* | Δb* | ΔE |
|---|---|---|---|---|
| 10.08 | −0.60 | 0.45 | 0.60 | 0.96 |
| 10.5 | −1.12 | 0.48 | 0.81 | 1.46 |
| 10.6 | −0.79 | −0.09 | 1.99 | 2.15 |
| 10.7 | −0.69 | −0.47 | 2.07 | 2.23 |
| 10.8 | −0.87 | −0.12 | 2.23 | 2.4 |

Dyed fabric samples were subjected to multiple washings to determine washfastness of the dye color. On a qualitative scale from 1 to 5, with 5 indicating maximum color retention, the samples all were rated 5 in both five and ten washings.

Example 2

Dyeing Cotton With Indigo Dye Using SBH/SBS

Cotton was dyed as described in Example 1, but with a dyebath initial pH of 9.65. Color test results from this dyebath were measured relative to an indigo-dyed fabric (using hydrosulfite under similar conditions) having color characteristics on the L*a*b* color scale of L*:16.26, a*:1.72 and b*:−12.71. The dyed fabric had ΔL*=−0.56, $\Delta a^*=0.45$, $\Delta b^*=0.61$ and $\Delta E=0.94$. Washfastness testing through five washings produced a maximum rating of 5 on a scale from 1 to 5.

Comparative Example 1

Dyeing Cotton With Indigo Dye Using Hydrosulfite

The master batch was prepared with the following amounts:

| Ingredient | Amount, g/L | g/L Active Ingredient |
|---|---|---|
| NaOH, 50% | 153.8 | 76.9 |
| hydrosulfite, 90% | 85.7 | 77.1 |
| Indigo Dye (Vat Blue 1) | 100 | 100 |

The pH of the master batch was 12.97 and the ORP was −949 mV. The master batch was allowed to stand for two hours at ambient temperature without agitation and then a portion was combined with additional hydrosulfite and sodium hydroxide to produce the initial dyebath, as follows, with amounts expressed per liter of dyebath:

| Ingredient | Amount | g/L Active Ingredient |
|---|---|---|
| Master Batch | 14.67 mL/L | hydrosulfite: 1.131<br>dye: 1.467 |
| hydrosulfite, 90% | 0.65 g/L | 0.585 |
| NaOH, 50% | 1.32 g/L | 0.66 |

The pH of the dyebath when formed was 12.31 and the ORP was −742 mV.

Cotton yarn was dyed with this dyebath according to the procedure described above in Example 1. Color test results from yarn produced in this dyebath indicated color characteristics on the L*a*b* color scale of L*:19.41, a*:0.03 and b*:−15.24.

These results indicate that although similar color results were obtained from hydrosulfite, a larger concentration of indigo dye was required in the dyebath.

Dyed fabric samples were subjected to multiple washings to determine washfastness of the dye color. On a qualitative scale from 1 to 5, with 5 indicating maximum color retention, all of the samples were rated 3–4 or 4–5.

Comparative Example 2

Dyeing Cotton With Indigo Dye Using SBH/SBS at High pH

The master batch and dyebath were prepared using the amounts and procedures of Example 1, except that 1.32 g/L of 50% NaOH were added to the dyebath to raise the dyebath initial pH to 11.35. Color test results for yarn dyed according to this procedure, and for yarn dyed with hydrosulfite, are presented in the following table.

| Reductant | L* | a* | b* | ΔE |
|---|---|---|---|---|
| hydrosulfite | 15.82 | 1.54 | −13.05 | — |
| SBH/SBS | 17.84 | 1.18 | −15.85 | 2.94 |

The lightness (indicated by higher L*) of the high-pH SBH/SBS yarn, as well as its decreased redness (indicated by lower a*) was considered unacceptable for commercial use. Moreover, the overall ΔE is higher than that obtained for the lower-pH SBH/SBS runs, indicating inferior results at higher pH.

The invention claimed is:

1. A method for dyeing textiles with reducible dyes; said method comprising steps of: forming a dyebath by the steps comprising:

(a) forming an initial aqueous mixture comprising water, a hydroxide compound, a bisulfite compound, a borohydride compound and a reducible dye;

(b) allowing said initial aqueous mixture to stand for 1 to 3 hours; and (c) adding additional ingredients consisting essentially of a borohydride compound, a bisulfite compound, water and optionally hydroxides, surfactants, and finishing agents and (ii) contacting the dyebath with a textile comprising cotton;

wherein the dyebath has a pH from 9 to 11 when formed.

2. The method of claim 1 in which the bisulfite compound is added in step (a) in an amount from 65 to 180 grams per liter of the initial aqueous mixture, the borohydride compound is added in step (a) in an amount from 2 to 6 grams per liter of the initial aqueous mixture.

3. The method of claim 2 in which the dyebath has a pH from 9.5 to 10.6 when formed and the reducible dye is an indigoid dye.

4. The method of claim 3 in which the bisulfite compound is sodium bisulfite and the borohydride compound is sodium borohydride.

* * * * *